US012342904B2

(12) United States Patent
Byun et al.

(10) Patent No.: US 12,342,904 B2
(45) Date of Patent: Jul. 1, 2025

(54) SLIPPER

(71) Applicant: BARC Co., Ltd., Busan (KR)

(72) Inventors: Justin Byun, Seoul (KR); Kwang Ho Ahn, Seoul (KR)

(73) Assignee: BARC Co., Ltd., Busan (KR)

( * ) Notice: Subject to any disclaimer, the term of this patent is extended or adjusted under 35 U.S.C. 154(b) by 0 days.

(21) Appl. No.: 18/499,574

(22) Filed: Nov. 1, 2023

(65) Prior Publication Data

US 2024/0148100 A1 May 9, 2024

(30) Foreign Application Priority Data

Nov. 4, 2022 (KR) ..... 10-2022-0145767

(51) Int. Cl.

| | |
|---|---|
| ***A43B 13/18*** | (2006.01) |
| ***A43B 3/10*** | (2006.01) |
| ***A43B 3/24*** | (2006.01) |
| ***A43B 13/36*** | (2006.01) |

(52) U.S. Cl.

CPC ..... *A43B 3/101* (2013.01); *A43B 3/107* (2013.01); *A43B 3/108* (2013.01); *A43B 3/244* (2013.01); *A43B 13/186* (2013.01); *A43B 13/187* (2013.01); *A43B 13/36* (2013.01)

(58) Field of Classification Search

CPC ..... A43B 13/187; A43B 13/186; A43B 3/244; A43B 13/36

USPC ..... 36/15, 28, 25 R

See application file for complete search history.

(56) References Cited

U.S. PATENT DOCUMENTS 4,267,650 A * 5/1981 Bauer ..... A43B 3/24 36/15
4,316,335 A * 2/1982 Giese ..... A43B 7/1445 36/129
4,364,188 A * 12/1982 Turner ..... A43B 5/06 36/31
4,377,042 A * 3/1983 Bauer ..... A43B 13/36 36/15
4,667,423 A * 5/1987 Autry ..... A43B 17/02 36/102
4,768,295 A * 9/1988 Ito ..... A43B 13/18 36/28

(Continued)

FOREIGN PATENT DOCUMENTS

JP 2010-246785 A 11/2010
KR 10-2004-0054868 A 6/2004

(Continued)

OTHER PUBLICATIONS

Korean Notice of Allowance for KR 10-2022-0145767, dated Dec. 23, 2022.
Korean Office Action for 10-2022-0145767, dated Dec. 13, 2022.

*Primary Examiner* — Marie D Bays
(74) *Attorney, Agent, or Firm* — Sughrue Mion, PLLC

(57) ABSTRACT

Provided is a slipper including an outsole 100 in contact with a floor, a midsole 200 assembled on an upper side of the outsole 100 and supporting a foot of a user, and a balance foam 300 disposed between the outsole 100 and the midsole 200 and made of a memory foam material. The slipper is to be modified to fit a shape of the sole of the foot of the user by placing a balance form between the outsole and the midsole, thereby improving the wearing comfort of the user.

2 Claims, 9 Drawing Sheets

(56) References Cited

U.S. PATENT DOCUMENTS 5,083,385 A * 1/1992 Halford ..... A43B 13/36 36/100
5,325,611 A * 7/1994 Dyer ..... A43B 13/12 36/27
5,661,915 A * 9/1997 Smith ..... A43C 15/00 36/102
5,956,869 A * 9/1999 Kim ..... A43B 13/20 36/28
6,038,790 A * 3/2000 Pyle ..... A43B 7/144 36/28
6,505,420 B1 * 1/2003 Litchfield ..... A43B 13/203 36/43
6,589,630 B1 * 7/2003 Crow ..... C08L 9/00 36/43
8,307,569 B2 * 11/2012 McInnis ..... A43B 13/203 36/35 B
8,316,560 B2 * 11/2012 Caron ..... A43B 13/189 36/25 R
2010/0251565 A1 * 10/2010 Litchfield ..... A43B 13/145 36/35 B
2010/0281712 A1 * 11/2010 Campbell ..... B29D 35/12 36/35 R
2019/0142110 A1 * 5/2019 Cruz ..... A43B 3/16 36/15

FOREIGN PATENT DOCUMENTS

KR 10-2019-0044616 A 5/2009
KR 20-0449828 Y1 8/2010
KR 20-0457790 Y1 1/2012
KR 10-2019-0000680 A 1/2019
KR 10-2379749 B1 3/2022
KR 20-2022-002004 U 8/2022
KR 10-2022-0146377 A 11/2022

* cited by examiner

【FIG. 1】
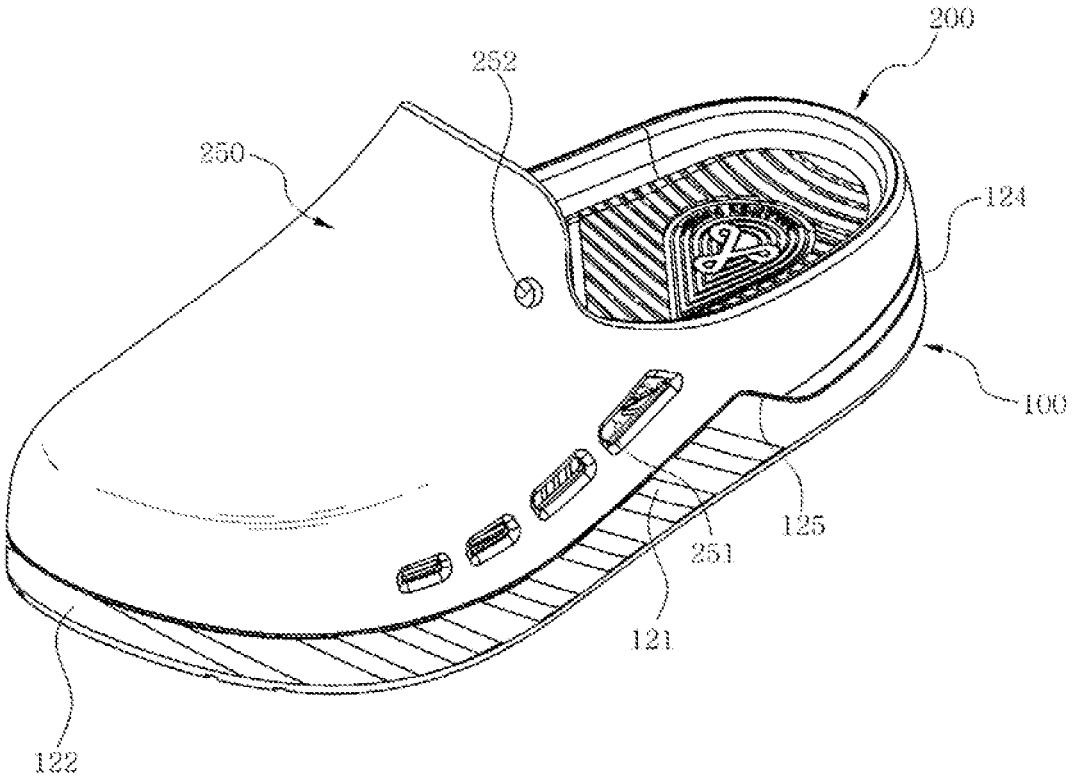

【FIG. 2】
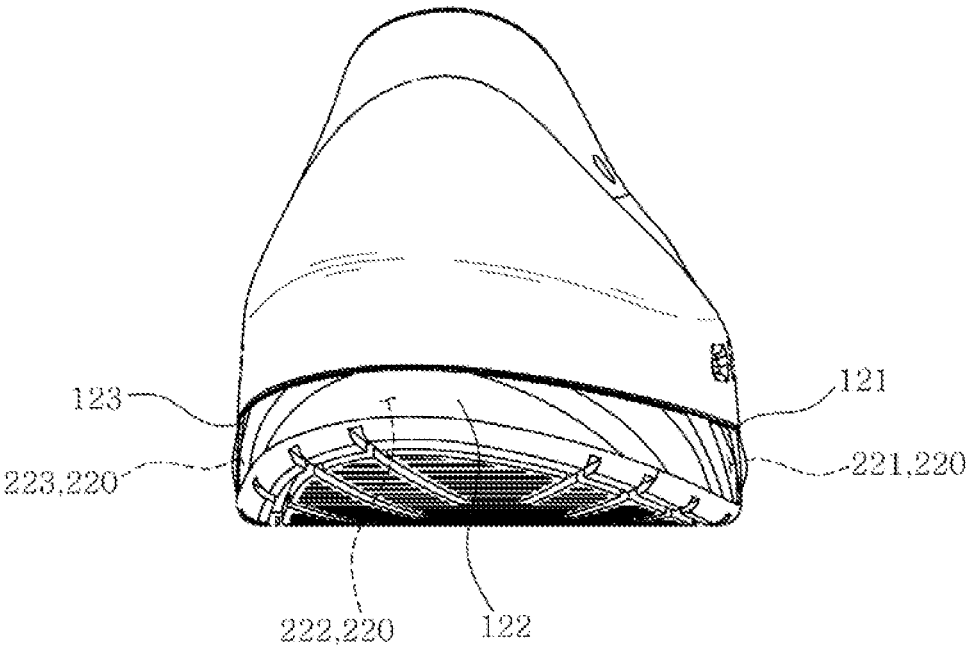
【FIG. 3】
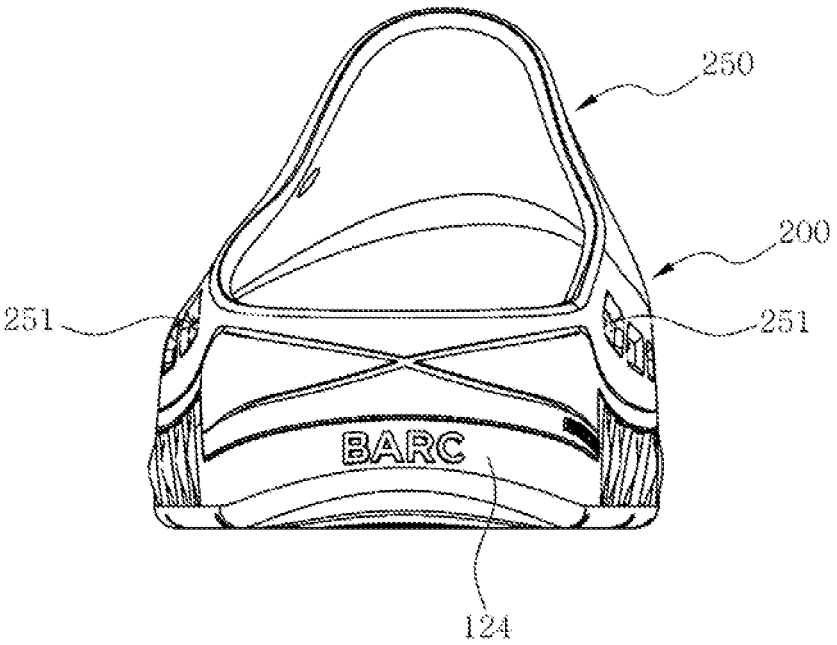

【FIG. 4】
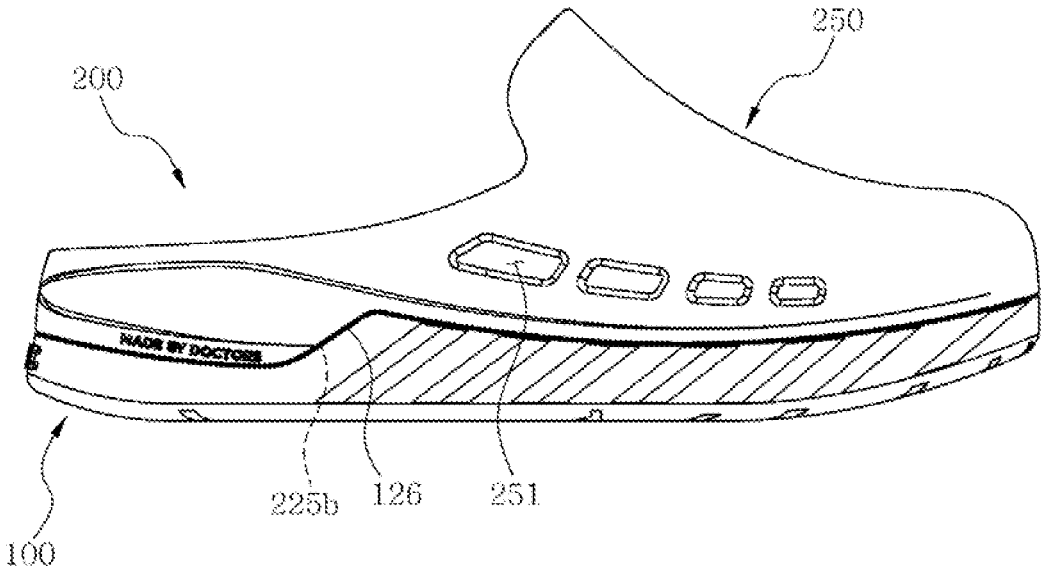
【FIG. 5】
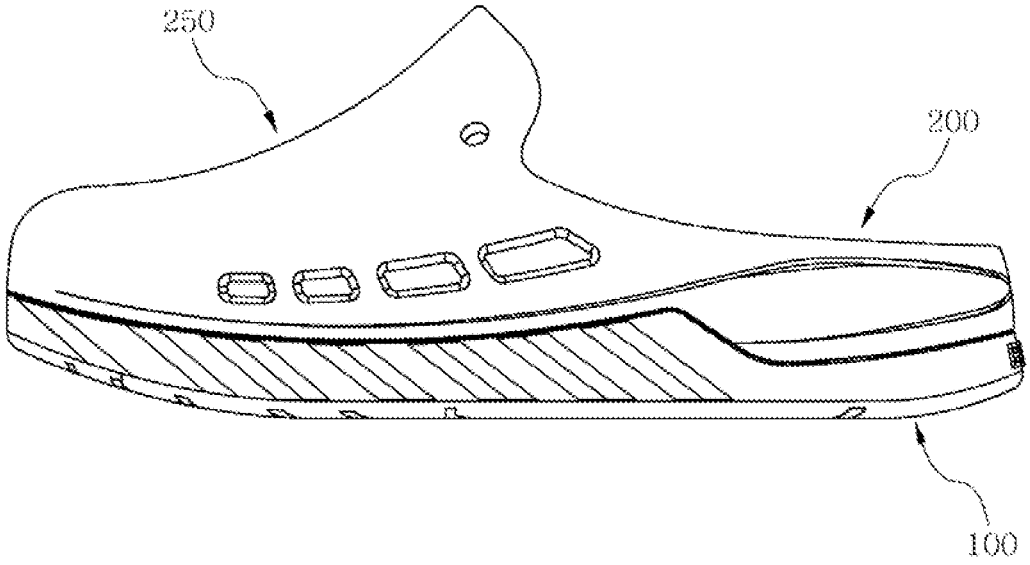

【FIG. 6】
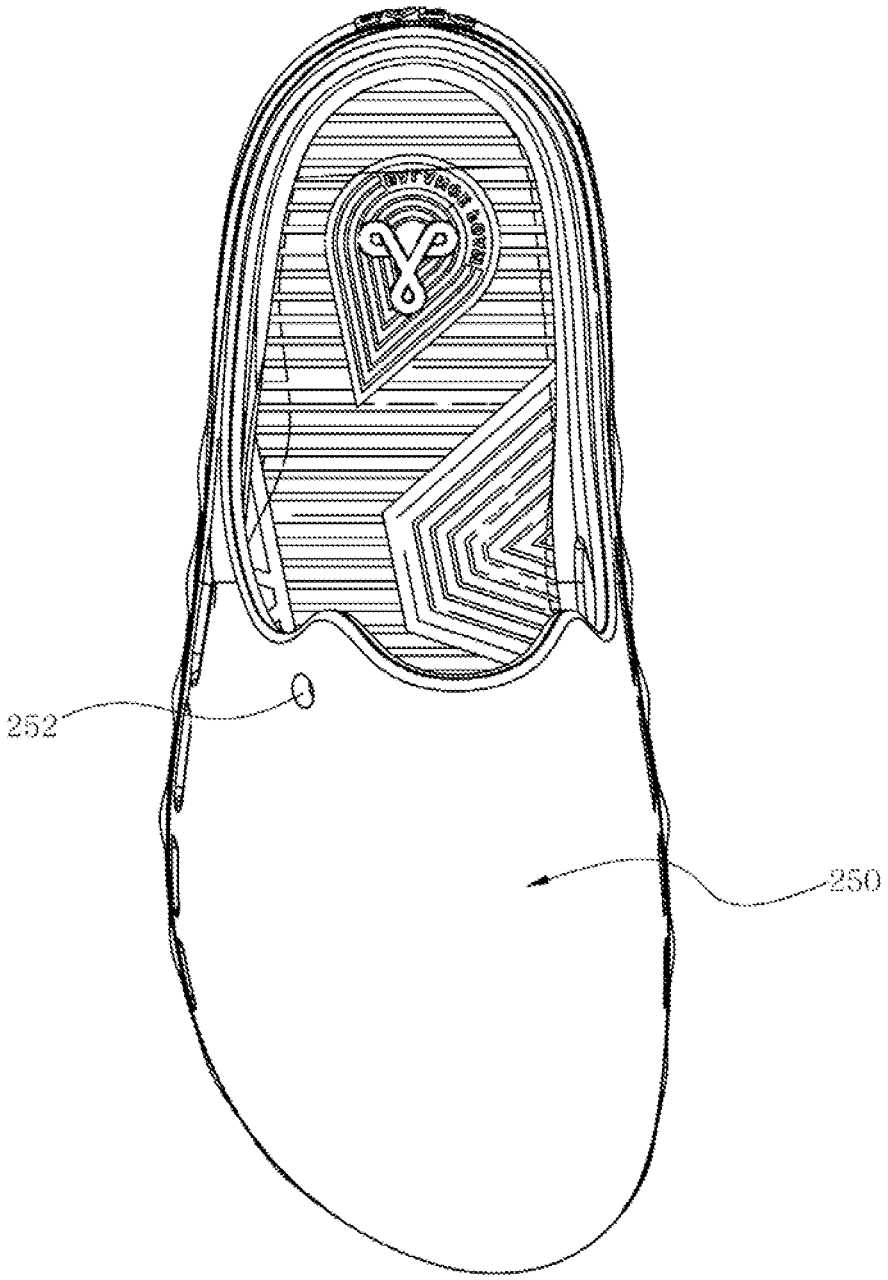

【FIG. 7】
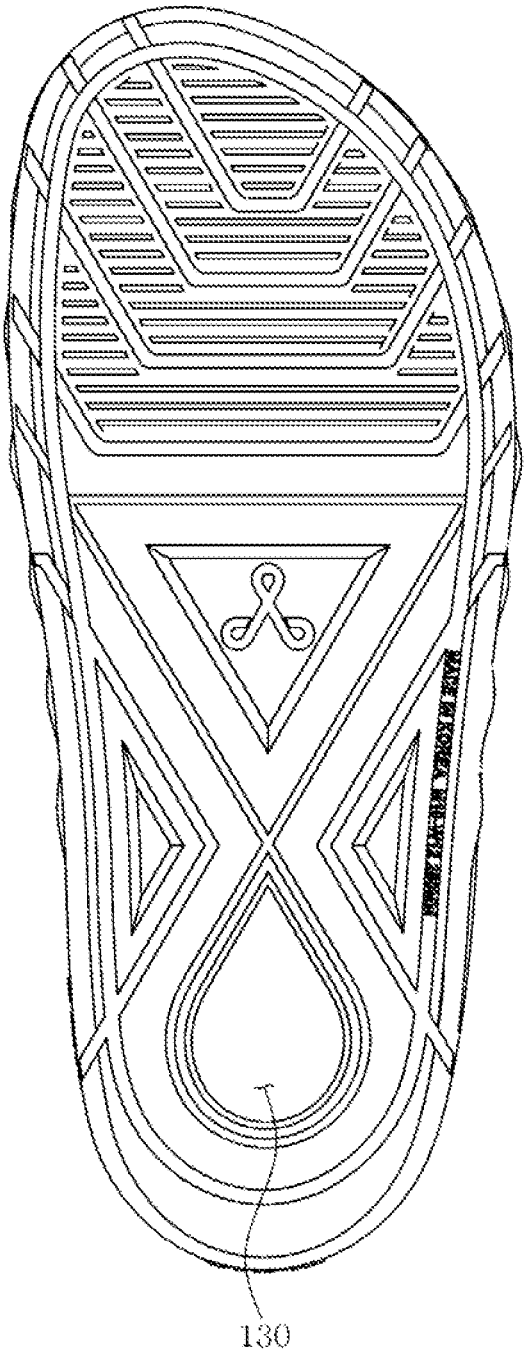

【FIG. 8】
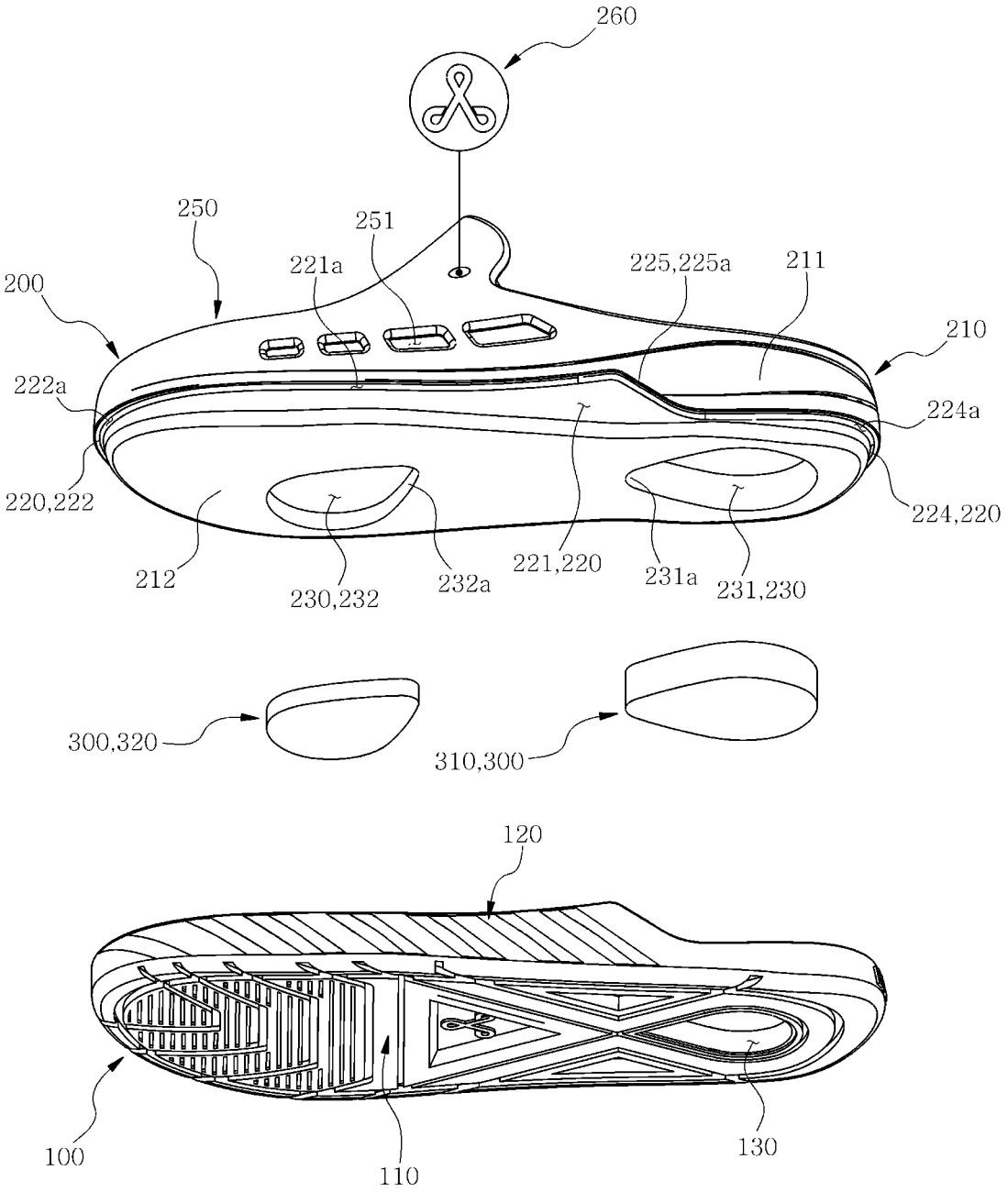

【FIG. 9】
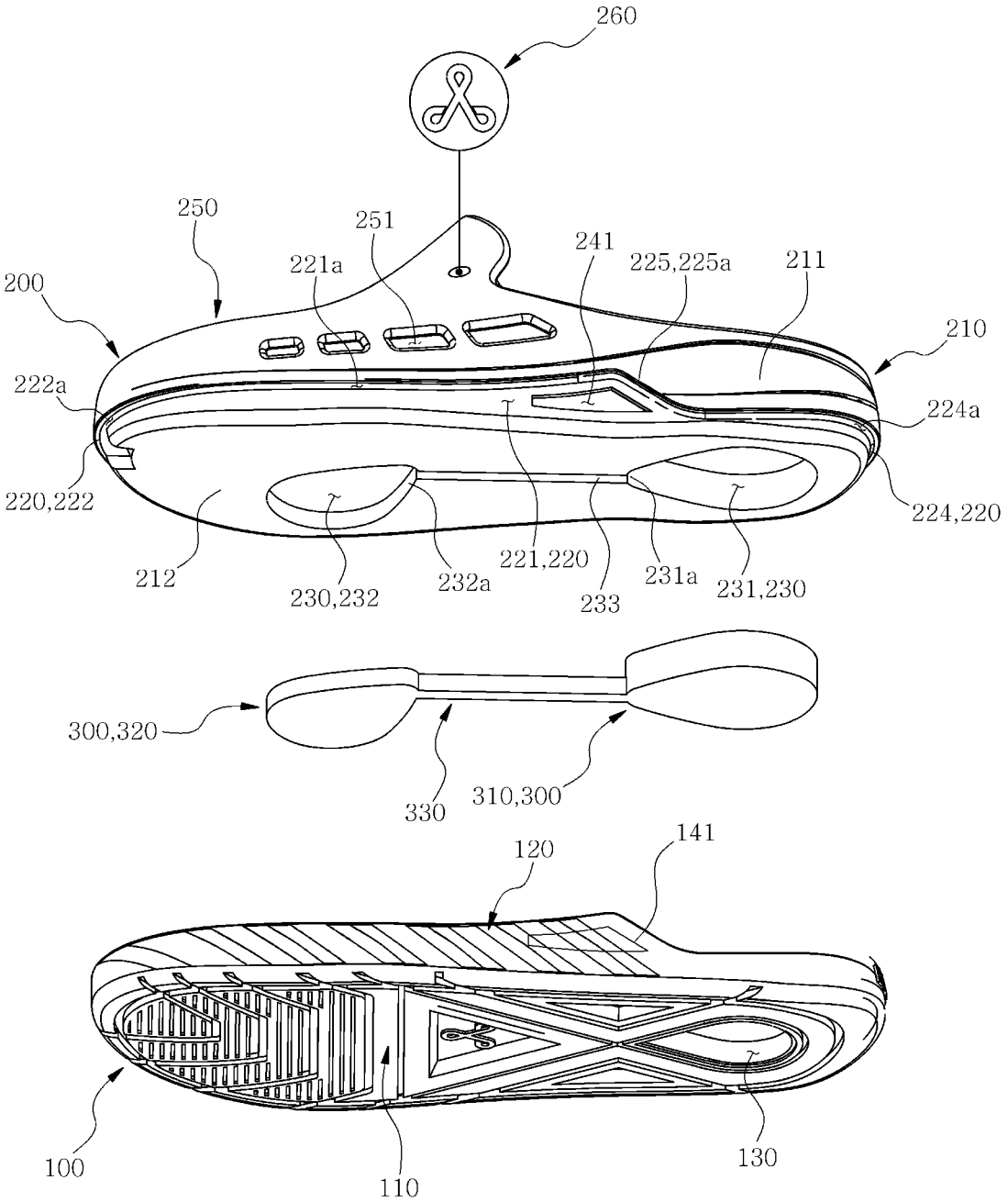

【FIG. 10】
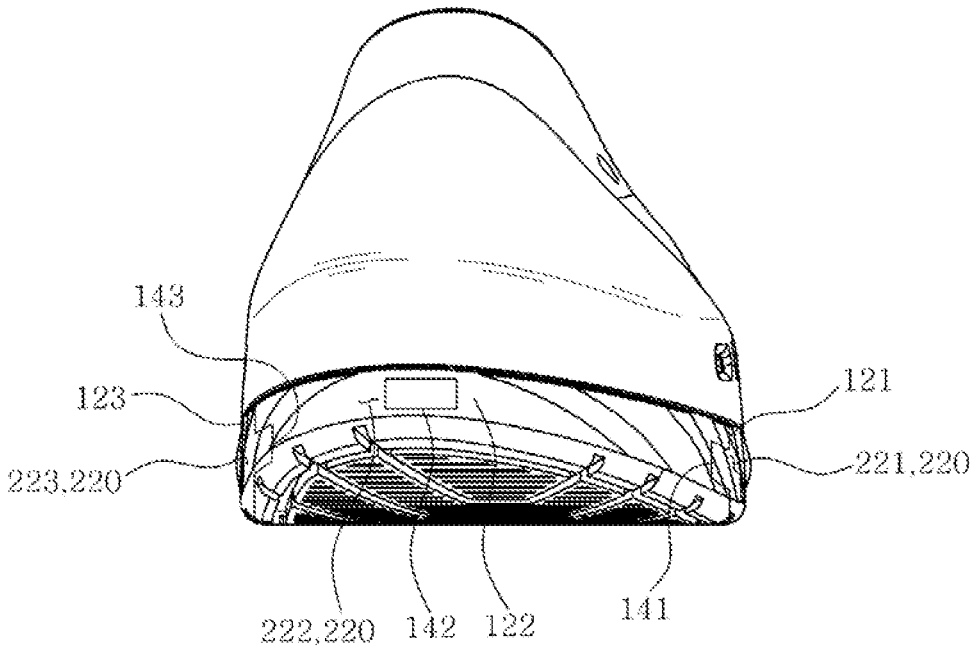
【FIG. 11】
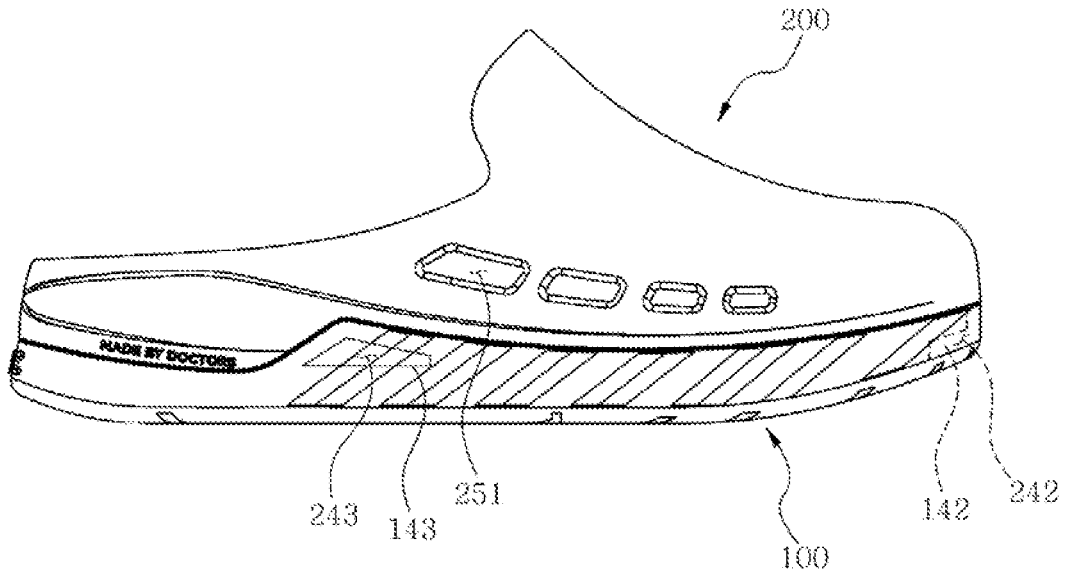

【FIG. 12】
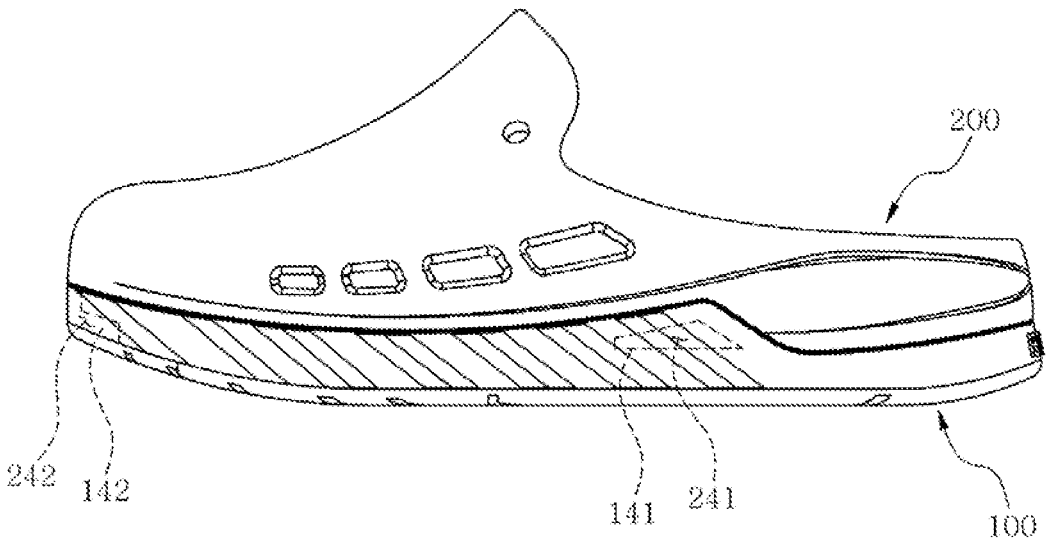
【FIG. 13】
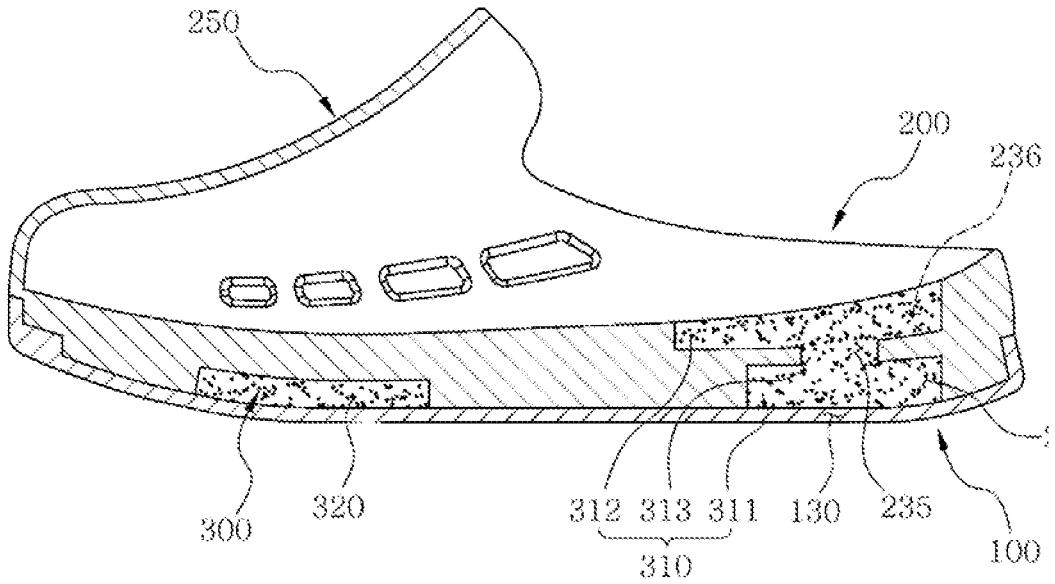

SLIPPER

CROSS-REFERENCE TO RELATED APPLICATION

This application claims priority to and the benefit of Korean Patent Application No. 2022-0145767, filed on Nov. 4, 2022, the disclosure of which is incorporated herein by reference in its entirety.

BACKGROUND OF THE INVENTION

1. Field of the Invention

The present disclosure relates to a slipper.

2. Description of the Related Art

Generally, a slipper includes a midsole with which the sole of the foot of a user comes into contact, an outsole that is in contact with a floor, and a strap that surrounds the instep of the foot. The midsole is usually made of a foam-molded structure of various synthetic resin materials, and the outsole has abrasion resistance and anti-slip functions.

Both the midsole and the outsole are made of lightweight materials with excellent resilience to absorb shock when landing on the ground.

However, when a product is manufactured with a focus only on lightweighting and shock absorption, in the event of an unexpected walking accident, the foot may not be fixed stably and may come off slippers, resulting in further injury.

Recently, the use of slippers with integrated soles and uppers made of EVA and PVC materials has increased. In this case, since the entire sole is made of the same material, the entire sole is manufactured with the same strength, and thus the sole is effective in cushioning shock, but there is a problem in that the sole is vulnerable to slipping or twisting.

CITED REFERENCE

Patent Document (Patent Document 1) Korean Patent No. 10-2379749

(Patent Document 2) Korean Utility Model No. 20-0449828

(Patent Document 3) Korean Utility Model Publication No. 20-2022-0002004

SUMMARY OF THE INVENTION

Therefore, the present disclosure has been made in view of the above problems, and it is an object of the present disclosure to provide a slipper that minimizes foot fatigue by implementing shock dispersion and shock absorption and also minimizing a walking accident such as unexpected falls forward or backward or slipping on one foot.

In accordance with the present disclosure, the above and other objects can be accomplished by the provision of a slipper including an outsole 100 in contact with a floor, a midsole 200 assembled on an upper side of the outsole 100 and supporting a foot of a user, and a balance foam 300 disposed between the outsole 100 and the midsole 200 and made of a memory foam material.

The midsole 200 may include a midbody 210 supporting a sole of the foot of the user, a toe cap portion 250 disposed in front of the midbody 210 and covering a part of an instep of the foot of the user, an insertion portion 230 that is formed concavely upward from a lower surface 212 of the midbody 210 and into which the balance foam 300 is inserted, and a cover groove 220 that is inwardly and concavely formed along an outer surface 211 of the midbody 210.

The outsole 100 may include an outbody portion 110 that is in close contact with a bottom surface of the midbody 210, a cover portion 120 that protrudes upward from an outer edge of the outbody portion 110 and is in close contact with and surrounds the cover groove 220, and a foam hole 130 disposed below the balance foam 300 and formed through the outbody portion 110 in up and down directions, and a bottom surface of the balance foam 300 may be exposed downward through the foam hole 130.

The insertion portion 230 may include a first insertion portion 231 positioned below a heel bone of the user, and a second insertion portion 232 positioned below a first metatarsal bone of the user, the balance foams 300 may include a first foam 310 inserted into the first insertion portion 231, and a second foam 320 inserted into the second insertion portion 232, and the foam hole 130 may be disposed below the first foam 310.

The cover portion 120 may include a first cover portion 121 formed at a right side of the outbody portion 110, a second cover portion 122 connected to the first cover portion 121 and formed at a front side, a third cover portion 123 connected to the second cover portion 122 and formed at a left side, a fourth cover portion 124 connecting the first cover portion 121 and the third cover portion 123 to each other and formed at a rear side, a first inclined cover portion 125 connecting the first cover portion 121 and the fourth cover portion 124 to each other, and a second inclined cover portion 126 connecting the third cover portion 123 and the fourth cover portion 124 to each other.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a perspective view of a slipper according to a first embodiment of the present disclosure;

FIG. 2 is a front view of FIG. 1;

FIG. 3 is a rear view of FIG. 1;

FIG. 4 is a left side view of FIG. 1;

FIG. 5 is a right side view of FIG. 1;

FIG. 6 is a plan view of FIG. 1;

FIG. 7 is a bottom view of FIG. 1;

FIG. 8 is an exploded perspective view of FIG. 1;

FIG. 9 is an exploded perspective view of a slipper according to a second embodiment of the present disclosure;

FIG. 10 is a front view of a slipper according to a second embodiment of the present disclosure;

FIG. 11 is a left side view of FIG. 10;

FIG. 12 is a right side view of FIG. 10; and

FIG. 13 is a side cross-sectional view of a slipper according to a third embodiment of the present disclosure.

DETAILED DESCRIPTION OF THE INVENTION

Exemplary embodiments of the present disclosure are described in detail so as for those of ordinary skill in the art to easily implement with reference to the accompanying drawings. However, the present disclosure may be implemented in various different forms and is not limited to these embodiments. To clearly describe the present disclosure, a part without concerning to the description is omitted in the drawings, and like reference numerals in the specification denote like elements.

Throughout this specification, unless explicitly described to the contrary, the word "comprise" and variations such as "comprises" or "comprising", will be understood to imply the inclusion of stated elements but not the exclusion of any other elements.

FIG. 1 is a perspective view of a slipper according to a first embodiment of the present disclosure. FIG. 2 is a front view of FIG. 1. FIG. 3 is a rear view of FIG. 1. FIG. 4 is a left side view of FIG. 1. FIG. 5 is a right side view of FIG. 1. FIG. 6 is a plan view of FIG. 1. FIG. 7 is a bottom view of FIG. 1. FIG. 8 is an exploded perspective view of FIG. 1.

The slipper according to the present embodiment is a clog type slipper in which the front of the toes of a user is closed.

The slipper according to the present embodiment includes an outsole 100 in contact with a floor, a midsole 200 assembled on an upper side of the outsole 100 and supporting the foot of the user, and a balance foam 300 disposed between the outsole 100 and the midsole 200 and made of a memory foam material.

The outsole 100 and the midsole 200 are adhered and fixed through an adhesive.

The midsole 200 includes a midbody 210 supporting the sole of the foot of the user, a toe cap portion 250 disposed in front of the midbody 210 and covering a part of the toes and instep of the foot of the user, and an insertion portion 230 that is formed concavely upward from a lower surface 212 of the midbody 210 and into which the balance foam 300 is inserted.

In the present embodiment, an inwardly concave cover groove 220 is formed along an outer surface 211 of the midbody 210. The outsole 100 is coupled to the cover groove 220 to provide a continuous surface with the outer surface 211.

The cover groove 220 may include a first cover groove 221 formed on a right surface, a second cover groove 222 connected to the first cover groove 221 and formed on a front surface, and a third cover groove 223 connected to the second cover groove 222 and formed on a left surface.

In the present embodiment, the cover groove 220 may further include a fourth cover groove 224 connecting the first cover groove 221 and the third cover groove 223 and formed on a rear surface.

In the present embodiment, the first cover groove 221, the second cover groove 222, and the third cover groove 223 are continuously connected and formed integrally with the midbody 210.

Due to the first cover groove 221, the second cover groove 222, and the third cover groove 223, a width between the first cover groove 221 and the third cover groove 223 is formed shorter than the width of the toe cap portion 250.

Unlike the present embodiment, a front part of the toe cap portion 250 may be open such that the toes of the user are exposed.

The insertion portion 230 includes a first insertion portion 231 positioned below the heel one of the user, and a second insertion portion 232 positioned below the first metatarsal bone of the user. The first metatarsal bone is the generally speaking forefoot, and may be a lower side connected to the big toe bone.

The first insertion portion 231 and the second insertion portion 232 are formed concavely upward from the lower surface 212 of the midbody 210.

When viewed from the bottom view, the first insertion portion 231 and the second insertion portion 232 may have a water drop shape. A water drop-shaped sharp portion 231*a* of the first insertion portion 231 may be positioned to face the middle toe, and a water drop-shaped sharp portion 232*a* of the second insertion portion 232 may be positioned to face the lateral malleolus.

The sharp portions 231*a* and 232*a* of the first insertion portion 231 and the second insertion portion 232 may be arranged to face different directions, the load on the sole of the foot of the user may be distributed in different directions.

The balance foam 300 includes a first foam 310 inserted into the first insertion portion 231, and a second foam 320 inserted into the second insertion portion 232.

The first foam 310 has a shape corresponding to the first insertion portion 231, and the second foam 320 has a shape corresponding to the second insertion portion 232.

The first foam 310 is formed slightly larger than the first insertion portion 231, and the second foam 320 is formed slightly larger than the second insertion portion 232.

In the present embodiment, the first foam 310 is formed from 105% to 110% of the first insertion portion 231, and the second foam 320 is formed from 105% to 110% of the second foam 320.

The first foam 310 and the second foam 320 may be made of a memory foam material and may be modified according to a shape of the sole of the foot of the user, thereby improving wearing comfort.

The upper ends 221*a*, 222*a*, and not shown of the first cover groove 221, the second cover groove 222, and the third cover groove 223 are continuously connected.

A slope 225 may be further disposed to connect the upper ends 221*a* and not shown of the first cover groove 221 and the third cover groove 223 to an upper end 224*a* of the fourth cover groove 224.

The slope 225 may be disposed at each of right and left sides of the midbody 210. The sharp portion 231*a* of the first insertion portion 231 is disposed within the length of the slope 225.

The slope 225 may be arranged in a front-to-rear direction and may have a front end positioned high and a rear end positioned low.

The height of the fourth cover groove 224 is lower than the height of each of the first cover groove 221 and the third cover groove 223, and the slope 225 connects the fourth cover groove 224 to the first cover groove 221 and the third cover groove 223 to make up for this height difference.

Since a larger load is formed on the heel bone of the foot, the volume of the midbody 210 is increased to support the load more firmly.

The slope 225 may be disposed at each of rear ends of the first cover groove 221 and the third cover groove 223. When right and left slopes are distinguished from each other, the right and left slopes are referred to as a first slope 225*a* and a second slope 225*b*.

In the present embodiment, front ends of the fourth cover groove 224 may be connected to the first slope and the second slope, respectively.

The entire first insertion portion 231 is disposed between a front end of each of the first slope and the second slope and a rear end of the third cover groove 223.

The front of the toe cap portion 250 is closed.

A plurality of vent holes 251 are formed through the toe cap portion 250.

The vent holes 251 are disposed at left and right sides of the toe cap portion 250, respectively.

When the vent holes 251 need to be distinguished from each other, a vent hole disposed at a right side is referred to as a first vent hole, and a vent hole disposed at a left side is referred to as a second vent hole.

A decoration hole 255 formed through the toe cap portion 250 may be further disposed above the vent hole 251.

A symbol 260 may be further disposed through the decoration hole 255.

The symbol 260 may be installed selectively by the user, and when multiple pairs of slippers are placed, the symbol 260 may be installed to distinguish users from each other.

The outsole 100 further includes an outbody portion 110 that is in close contact with a bottom surface of the midbody 210, a cover portion 120 that protrudes upward from an outer edge of the outbody portion 110 and is in close contact with and surrounds the cover groove 220, and a foam hole 130 disposed below the first foam 310 and formed through the outbody portion 110 in up and down directions.

The cover portion 120 includes a first cover portion 121 formed at a right side of the outbody portion 110, a second cover portion 122 connected to the first cover portion 121 and formed at a front side, a third cover portion 123 connected to the second cover portion 122 and formed at a left side, a fourth cover portion 124 connecting the first cover portion 121 and the third cover portion 123 to each other and formed at a rear side, a first inclined cover portion 125 connecting the first cover portion 121 and the fourth cover portion 124 to each other, and a second inclined cover portion 126 connecting the third cover portion 123 and the fourth cover portion 124 to each other.

The first cover portion 121 is formed to surround the first cover groove 221, the second cover portion 122 is formed to surround the second cover groove 222, the third cover portion 123 is formed to surround the third cover groove 223, and the fourth cover portion 124 is formed to surround the fourth cover groove 224.

The first inclined cover portion 125 has a shape corresponding to the first slope 225*a*, and the second inclined cover portion 126 has a shape corresponding to the second slope.

The first cover portion 121, the second cover portion 122, the third cover portion 123, and the fourth cover portion 124 form a continuous surface with the outer surface 211 of the midsole 200.

The foam hole 130 is formed smaller than an area of the first foam 310, and a portion of the bottom surface of the first foam 310 is exposed through the foam hole 130.

Since the bottom surface of the first foam 310 is exposed through the foam hole 130, when an excessive load is applied to the first foam 310, the slipper may be modified toward the foam hole 130 to reduce a repulsive force, and has a feature of reducing discomfort caused by excessive repulsive force when the user walks.

A coating may be formed on an outer surface of the balance foam 300. In particular, since the first foam 310 is discharged to the outside through the foam hole 130, a waterproof coating may be formed.

The balance foam 300 may be made of an ortholite material. The balance foam 300 may contain recycled rubber with 20 wt % to 40 wt %.

In particular, a TPU coating is formed on a surface of the first foam 310 exposed to the outside, thereby protecting the first foam 310 from moisture.

To coat a TPU solution on a surface of the balance foam 300, a TPU solution formed by dissolving TPU in dimethyl formaldehyde (DMF) (dimethyl formaldehyde, a colorless to light yellow water-soluble liquid, and mainly used as a solvent for polyurethane resin) or a TPU solution, the viscosity of which is adjusted by selectively adding toluene (methylbenzene) and methylethylketone (MEK) to the TPU solution, is used.

Accordingly, a dissolved TPU solution formed by dissolving TPU in DMF by mixing 6 to 9 parts by weight of DMF for 1 to 4 parts by weight of TPU while sufficiently mixing (stirring) for at least 1 hour at a temperature of about 150° C. to increase a dissolution rate may be used.

Alternatively, a TPU solution, the viscosity of which is adjusted by selectively adding a viscosity adjuster such as toluene or MEK to the TPU solution is used, and a mixing ratio of TPU, DMF, and the viscosity adjuster (toluene, MEK) may be 6 to 9 parts by weight of the sum of DMF and the viscosity adjuster for 1 to 4 parts by weight of TPU.

In other words, a TPU solution in which TPU is dissolved in DMF is used, or a TPU solution in which TPU is dissolved in DMF and the viscosity of which is adjusted by adding more toluene and MEK is used.

The TPU solution configured as such is manufactured to be dissolved quickly at a temperature of about 150° C., and the first foam 310 is dipped into a TPU solution at room temperature and coated with the TPU solution.

Removal of DMF contained in the TPU solution (this process is referred to as de-DMF, and to coat the first foam with pure TPU on the first foam, the de-DMF process is necessary) is to remove DMF contained in the TPU solution coated on the first foam 310. For reference, toluene and MEK, which control viscosity, are volatile, and thus removal thereof is not performed separately.

Accordingly, to remove DMF contained in the TPU solution coated on the first foam 310, the first foam 310 coated with the TPU solution is soaked in a DMF aqueous solution 153 of 10% (a state of 25 to 30° C. may be maintained), and a solidification speed of the TPU solution is slow, and thus an effect of increasing the solidification speed of the TPU solution during the de-DMF process may be achieved, and for reference, a DMF aqueous solution of 10% is an aqueous solution in which 10 parts by weight of DMF are dissolved in 90 parts by weight of water.

FIG. 9 is an exploded perspective view of a slipper according to a second embodiment of the present disclosure.

The slipper according to the present embodiment, unlike the first embodiment, has a feature that the first foam 310 and the second foam 320 are connected as one through a connection foam 330.

Accordingly, the balance foam 300 according to the present embodiment includes the first foam 310 inserted into the first insertion portion 231, the second foam 320 inserted into the second insertion portion 232, and the connection foam 330 connecting the first foam 310 and the second foam 320 to each other.

The insertion portion 230 according to the present embodiment includes the first insertion portion 231 positioned below the heel bone of the user, the second insertion portion 232 positioned below the first metatarsal bone of the user, and a connection insertion portion 233 connecting the first insertion portion 231 and the second insertion portion 232 to each other.

The width of the connection insertion portion 233 is formed shorter than a width of each of the first insertion portion 231 and the second insertion portion 232.

The connection insertion portion 233 is hidden from the outside when the outsole 100 is coupled to the midsole 200.

Since the connection insertion portion 233 connects the first insertion portion 231 and the second insertion portion 232 to each other, the first foam 310 exposed to the outside may be prevented from being unintentionally separated from the first insertion portion 231.

The slipper according to the present embodiment further include a first outsole fixing portion 141 that protrudes toward the first cover groove 221 from an inner surface of the first cover portion 121, a first fixing groove 241 that is formed concavely from the first cover groove 221 to the third cover groove 223 and into which the first outsole fixing portion 141 is press-fit, a second outsole fixing portion 142 that protrudes toward the second cover groove 222 from an inner surface of the second cover portion 122, a second fixing groove 242 that is formed concavely from the second cover groove 222 to the fourth cover groove 224 and into which the second outsole fixing portion 142 is press-fit, a third outsole fixing portion 143 that protrudes toward the third cover groove 223 from an inner surface of the third cover portion 123, and a third fixing groove 243 that is formed concavely from the third cover groove 223 to the first cover groove 221 and into which the third outsole fixing portion 143 is press-fit.

When the outsole 100 and the midsole 200 are adhesively fixed, an adhesive is also applied to the first fixing groove 241, the second fixing groove 242, and the third fixing groove 243.

Based on the drawing, the first outsole fixing portion 141 protrudes to the left from the inner surface of the first cover portion 121, the third outsole fixing portion 143 protrudes to the right from the inner surface of the third cover portion 123, and the second outsole fixing portion 142 protrudes rearward from the inner surface of the second cover portion 122.

The second outsole fixing portion 142 connects an upper surface of the midbody 210 and the inner surface of the second cover portion 122 to each other, and the second fixing groove 242 may be opened downward.

When viewed from the side, the first fixing groove 241 and the third fixing groove 243 are formed in a triangular shape and are symmetrical left and right.

The second fixing groove 242 is formed in a square shape when viewed in plan.

In the present embodiment, the first fixing groove 241 and the third fixing groove 243 are formed in a shape of a right triangle, and an inclined surface is disposed to face downward.

Correspondingly, the first outsole fixing portion 141 and the third outsole fixing portion 143 are formed in a shape of a triangular pillar.

One of sides of the first outsole fixing portion 141 is formed parallel to the first inclined cover portion 125, and one of sides of the third outsole fixing portion 143 is formed parallel to the second inclined cover portion 126.

The first outsole fixing portion 141 is tightly press-fit into the first fixing groove 241, and when the outsole 100 and the midsole 200 are adhesively fixed, lifting and deformation of the outsole 100 and the midsole 200 may be prevented, thereby reducing manufacturing defects.

The third outsole fixing portion 143 is tightly press-fit into the third fixing groove 243, and when the outsole 100 and the midsole 200 are adhesively fixed, lifting and deformation of the outsole 100 and the midsole 200 may be prevented, thereby reducing manufacturing defects.

The second outsole fixing portion 142 is tightly press-fit into the second fixing groove 242, and when the outsole 100 and the midsole 200 are adhesively fixed, lifting and deformation of the outsole 100 and the midsole 200 may be prevented, thereby reducing manufacturing defects.

When the outsole 100 and the midsole 200 are assembled, front ends of the outsole 100 and the midsole 200 are fixed by coupling the second outsole fixing portion 142 to the second fixing groove 242, and then the first outsole fixing portion 141 and the third outsole fixing portion 143 are press-fit into the midbody 210.

Here, the second outsole fixing portion 142 and the second fixing groove 242 may function as a position guide to constrain adhesion positions of the outsole 100 and the midsole 200.

When the second outsole fixing portion 142 and the second fixing groove 242 are not present, the outsole 100 and the midsole 200 may be misaligned and may cause defects.

When the second outsole fixing portion 142 and the second fixing groove 242 are coupled to each other, the adhesion positions of the outsole 100 and the midsole 200 are determined, and thus even unskilled workers may prevent adhesion failure.

Because the first outsole fixing portion 141 is laterally inserted into the first fixing groove 241 and is fit and adhesively fixed, the adhesive force and structural rigidity of the outsole 100 and the midsole 200 may be improved.

A direction in which the first outsole fixing portion 141 and the first fixing groove 241 are mutually locked and a direction in which the second outsole fixing portion 142 and the second fixing groove 242 are mutually locked may be different, and thus the coupling strength of the outsole 100 and the midsole 200 may be improved.

A direction in which the third outsole fixing portion 143 and the third fixing groove 243 are mutually locked and a direction in which the second outsole fixing portion 142 and the second fixing groove 242 are mutually locked may be different, and thus the coupling strength of the outsole 100 and the midsole 200 may be improved.

Hereinafter, the remaining configuration is similar to the first embodiment, and thus detailed description thereof will be omitted.

FIG. 13 is a side cross-sectional view of a slipper according to a third embodiment of the present disclosure.

The slipper according to the present embodiment, unlike the first embodiment, has a feature that the first foam 310 is also exposed through an upper surface 202 of the midsole 200.

The first foam 310 according to the present embodiment includes a first foam portion 311 inserted into the first insertion portion 231 and exposed downward through the foam hole 130, a second foam portion 312 exposed to an upper surface of the midsole 200, and a connection foam portion 313 connecting the first foam portion 311 and the second foam portion 312 to each other.

The midsole 200 further includes an upper insertion portion 236 that is concavely formed downward from the upper surface 202 of the midbody 210, an upper insertion portion 236 into the second foam portion 312 is inserted, and a connection insertion portion 235 connecting the upper insertion portion 236 and the first insertion portion 231 to each other.

The connection foam portion 313 may be narrower than each of the first foam portion 311 and the second foam portion 312.

The first foam portion 311, the second foam portion 312, and the connection foam portion 313 are formed of a memory foam material, and thus a worker may compress the first foam portion 311 and may then disposing the first foam portion 311 in the first insertion portion 231 through the connection insertion portion 235.

The first foam portion 311 is disposed below the connection foam portion 313, and the second foam portion 312 is disposed above the connection foam portion 313.

The first foam portion 311 may be maintained in a state caught by the first insertion portion 231 using the connection foam portion 313 and the second foam portion 312, and may be prevented from being separated to the outside through the foam hole 130.

The second foam portion 312 may be maintained in a state caught by the upper insertion portion 236 using the connection foam portion 313 and the first foam portion 311, and may be prevented from being separated toward an upper side of the upper insertion portion 236.

In the present embodiment, the volume and area of the second foam portion 312 are larger than those of the first foam portion 311.

The second foam portion 312 may be modified in direct contact with the sole of the foot of the user, thereby improving the wearing comfort of the user.

Hereinafter, the remaining configuration is similar to the first embodiment, and thus detailed description thereof will be omitted.

First, according to the present disclosure, a slipper may be modified to fit a shape of the sole of the foot of the user by placing a balance form between the outsole and the midsole, thereby improving the wearing comfort of the user.

Second, according to the present disclosure, a load of the sole of the foot of the user may be effectively reduced by configuring a balance foam as a plurality of foams of a first foam and a second foam, positioning the first foam below the heel bone of the foot, and positioning the second foam below the first metatarsal bone.

Third, according to the present disclosure, the first foam may be opened downward, and thus even if an excessive load is applied to the first foam, a space for downward modification may be ensured, thereby advantageously modifying a slipper quickly.

Fourth, according to the present disclosure, the first foam and the second foam may be connected to each other by the connection foam, and thus the first foam may be prevented from being separated to the outside through a foam hole.

Fifth, according to the present disclosure, the second outsole fixing portion may be press-fit into the second fixing groove to align a position of an outsole for adhesion, thereby reducing manufacturing defects.

Although the exemplary embodiments of the present disclosure have been disclosed for illustrative purposes, those skilled in the art will appreciate that various modifications, additions and substitutions are possible, without departing from the scope and spirit of the invention as disclosed in the accompanying claims.

[Description of reference numerals]

| | |
|---|---|
| 100: outsole | 110: outbody portion |
| 120: cover portion | 130: foam hole |
| 200: midsole | 210: midbody |
| 220: cover groove | 230: insertion portion |
| 250: toe cap portion | 300: balance foam |
| 310: first foam | 320: second foam |

What is claimed is:

1. A slipper comprising:

an outsole 100 in contact with a floor;

a midsole 200 assembled on an upper side of the outsole 100 and supporting a foot of a user; and a balance foam 300 disposed between the outsole 100 and the midsole 200 and made of a memory foam material, wherein the midsole 200 comprises:

a midbody 210 supporting a sole of the foot of the user;

a toe cap portion 250 disposed in front of the midbody 210 and covering a part of an instep of the foot of the user;

an insertion portion 230 that is formed concavely upward from a lower surface 212 of the midbody 210 and into which the balance foam 300 is inserted; and a cover groove 220 that is inwardly and concavely formed along an outer surface 211 of the midbody 210;

wherein the outsole 100 comprises:

an outbody portion 110 that is in close contact with a bottom surface of the midbody 210;

a cover portion 120 that protrudes upward from an outer edge of the outbody portion 110 and is in close contact with and surrounds the cover groove 220; and a foam hole 130 disposed below the balance foam 300 and formed through the outbody portion 110 in up and down directions;

wherein the insertion portion 230 comprises:

a first insertion portion 231 positioned below a heel bone of the user;

a second insertion portion 232 positioned below a first metatarsal bone of the user; and a connection insertion portion 233 connecting the first insertion portion 231 and the second insertion portion 232 to each other;

wherein the balance foams 300 comprises:

a first foam 310 inserted into the first insertion portion 231;

a second foam 320 inserted into the second insertion portion 232; and a connection foam 330 connecting the first foam 310 and the second foam 320 to each other, the connection foam 330 being inserted into the connection insertion portion 233;

wherein the foam hole 130 is disposed below the first foam 310;

wherein the first foam 310 comprises:

a first foam portion 311 inserted into the first insertion portion 231 and exposed downward through the foam hole 130;

a second foam portion 312 exposed to an upper surface of the midsole 200; and a connection foam portion 313 connecting the first foam portion 311 and the second foam portion 312 to each other; and wherein the midsole 200 comprises:

an upper insertion portion 236 that is concavely formed downward from an upper surface 202 of the midbody 210 and into which the second foam portion 312 is inserted; and a connection insertion portion 235 connecting the upper insertion portion 236 and the first insertion portion 231 to each other;

wherein the first foam portion 311 is disposed below the connection foam portion 313, wherein the second foam portion 312 is disposed above the connection foam portion 313; and wherein a volume and an area of the second foam portion 312 are larger than those of the first foam portion 311.

2. The slipper according to claim 1, wherein the cover portion 120 comprises:

a first cover portion 121 formed at a right side of the outbody portion 110;

a second cover portion 122 connected to the first cover portion 121 and formed at a front side;

a third cover portion 123 connected to the second cover portion 122 and formed at a left side;

a fourth cover portion 124 connecting the first cover portion 121 and the third cover portion 123 to each other and formed at a rear side;

a first inclined cover portion 125 connecting the first cover portion 121 and the fourth cover portion 124 to each other; and a second inclined cover portion 126 connecting the third cover portion 123 and the fourth cover portion 124 to each other.

* * * * *